US007935192B2

(12) United States Patent
Silverman et al.

(10) Patent No.: US 7,935,192 B2
(45) Date of Patent: May 3, 2011

(54) DRAIN CLEANING APPARATUS WITH RESTRICTED REVERSE FUNCTION

(75) Inventors: David Silverman, Pittsburgh, PA (US); Michael Silverman, Pittsburgh, PA (US); Anton D. Pfeiffer, Ambridge, PA (US)

(73) Assignee: General Wire Spring Co., McKees Rocks, PA (US)

( * ) Notice: Subject to any disclaimer, the term of this patent is extended or adjusted under 35 U.S.C. 154(b) by 149 days.

(21) Appl. No.: 12/329,777

(22) Filed: Dec. 8, 2008

(65) Prior Publication Data

US 2010/0139696 A1 Jun. 10, 2010

(51) Int. Cl.
*B08B 9/045* (2006.01)
*B08B 9/047* (2006.01)
*B08B 1/04* (2006.01)

(52) U.S. Cl. ..... 134/22.11; 134/8; 134/18; 15/104.09; 15/104.095; 15/104.16; 15/104.33

(58) Field of Classification Search ..... 134/8, 23, 134/32, 33, 22.11; 15/104.33, 104.03, 104.05, 15/104.09, 104.16, 104.31
See application file for complete search history.

(56) References Cited

U.S. PATENT DOCUMENTS 2,355,733 A * 8/1944 Johnson et al. ..... 15/104.33
3,159,861 A 12/1964 Sarcone
3,574,878 A 4/1971 Shames et al.
3,612,487 A 10/1971 Raney et al.
3,776,179 A 12/1973 Raney et al.
3,882,565 A 5/1975 Irwin et al.
3,958,293 A 5/1976 Irwin
4,364,139 A * 12/1982 Babb et al. ..... 15/104.33
4,839,936 A 6/1989 Prange
5,199,129 A 4/1993 Salecker et al.
5,222,270 A 6/1993 Sloter et al.
5,283,922 A 2/1994 Ruprecht
5,636,403 A 6/1997 Grimsley et al.
6,381,798 B1 5/2002 Rutkowski et al.
7,222,383 B2 5/2007 Hale
2005/0193509 A1 9/2005 Rutkowski et al.

* cited by examiner

*Primary Examiner* — Michael Barr
*Assistant Examiner* — Natasha Campbell
(74) *Attorney, Agent, or Firm* — Metz Lewis Brodman Must O'Keefe LLC; Barry I. Friedman

(57) ABSTRACT

A rotatable, portable drum auger drain cleaning device includes a rotational control which is biased towards the off position. The rotational control device is utilized in conjunction with a motor and the drum to direct drum rotation. The rotational control is typically biased in the off position making it the default position. The rotational control must therefore be manually moved to either a forward or reverse position. When in the forward position, the rotational control can be locked, and when in the reverse position, the switch must be manually held in position or the switch will return to the off position.

4 Claims, 9 Drawing Sheets

DRAIN CLEANING APPARATUS WITH RESTRICTED REVERSE FUNCTION

FIELD OF THE INVENTION

The present invention relates to a pipe, drain, or sewer cleaning apparatus and devices and, more particularly, to improvements in portable, motor operated drum augers.

BACKGROUND AND DESCRIPTION OF THE PRIOR ART

Portable drain cleaning devices are well known, being used by both professional plumbers and by the general public. Such drain cleaning devices generally include a snake, typically constituting a coiled cable, which may further be coiled inside a housing or drum from which an end of the snake protrudes from for the introduction into a pipe, sewer, drain or conduit. Often a tool is attached to the end of the snake entering the pipe or conduit, which aids in removing obstructions, for example by cutting away at the obstruction. Various tools may be interchanged with the end of the snake. The snake has the ability to rotate about its longitudinal axis as well as the ability to be axially displaced along such axis thereby creating a force used to remove obstructions in a space, for example a pipe or drain.

The ability of the snake to axially rotate and be axially displaced can be controlled by various mechanisms, and the combinations thereof, which apply a force to the snake. Often this force is applied by a motor, preferably a reversible motor, connected to a power supply. Typically the force translated from the motor to the snake, either directly or in conjunction with other mechanisms, will cause the snake to rotate about its longitudinal axis. This force may also cause the snake to elongate or retract from the drum or housing wherein it is encased when a feed mechanism is incorporated with the machine. Energization of the motor may be controlled by various devices, for example a switch. It is also typical for the direction of rotation of the motor to be controlled by a separate control device such as a lever or switch having the options of a forward, off, or reverse position. Typically the direction of rotation of the motor controls the direction of axial rotation of the drum and the snake. Additionally it is common for pneumatic switches to be used in conjunction with the motor, directed to the power supply to the motor, to further allow the operator to selectively control motor, drum, and snake rotation.

Many mechanisms have been used to increase the durability of drum augers and snakes. It is common in the art for the snake to become caught in an obstruction and become stuck. In such situations an overload of torque may be applied to various parts of the devices including but not limited to the motor, drum and snake. This can result in the deterioration and destruction of these mechanisms as well as other parts of the machine.

Torque limiting mechanisms are commonly used in conjunction with the various parts of drum augers, or other devices which include the use of a snake, to relieve strain and subsequent deterioration of various parts of the device.

U.S. Pat. No. 3,574,878 issued on Apr. 13, 1971 to Harold S. Ardley for a "Power Rooter with Safety Clutch" which teaches a spring loaded ball detent style clutch which prevents damage to a snake or burnout to the source of rotary power by slipping when a predetermined level of torque is experienced by the clutch.

U.S. Pat. No. 3,882,565 issued on May 13, 1975 to Lawrence F. Irwin and Fritz O. Ehrler for a "Spring Feed Device" where in the clutch is located within an automatic feed device. Irwin teaches that when the torque on the snake exceeds a predetermined amount of force the rate of feed of the snake slows and will stop once it has reached the predetermined amount of force. This is achieved by a spring loaded combination and chucking mechanism which engages the snake with less force as more it experiences more torque.

U.S. Pat. No. 4,364,139 issued on Dec. 21, 1982 to Larry F. Babb and Walter J. Noveske for a "Drum Type Sewer Cleaner" where a clutch can be adjusted from total slip to total lock. Babb teaches a clutch assembly being coupled to the motors drive shaft and having the ability to adjust the level of torque upon which the clutch will slip. Additionally Babb teaches the motor also having a breakdown torque.

U.S. Pat. No. 5,199,129 issued on Apr. 6, 1993 to Roy Salecker and Rockwell T. Slotter for a "Torque Monitoring System for Rotary Drain and Sewer Cleaning Apparatus" wherein a circuit measures motor drive torque levels and indicates to the operator when torque levels is above or below a predetermined torque level.

U.S. Pat. No. 5,22,270 issued on Jun. 29, 1993 to Rockwell T. Slotter and Roy Salecker for a "Electromagnetic Motor Brake Unit for Rotary Drain and Sewer Router" which teaches a brake which stops rotation of the drum. The cessation of drum rotation reduces any increased strain on the device due to the drum's possible continued rotation after power is no longer supplied to the motor. This thereby reduces the likelihood of the device tipping, opposite rotation of the drum occurring and/or breakage of the snake.

U.S. Pat. No. 6,381,798 issued on May 7, 2002 to Michael J. Rutkowski and Larry F. Babb for a "Spring Clutch for Drain Cleaning Machines" which teaches a spring arrangement which biases a drive motor on a belt driven drum-type drain cleaning machine and upon a predetermined amount of force will cause slippage between a the drive belt and drive pulley, thereby reducing torque on the snake.

The prior art addresses the problem of deterioration of the mechanisms incorporated in drum augers by mechanical means or by alerting the operator that there is an overload of torque. While such devices have improved the durability of the machine and increased safety, they do not have alternative limiting mechanisms that are directed to the direction of rotation of the drum and snake.

The prior art teaches many torque limiting mechanical devices that also deteriorate with increased use. For example a clutch that properly performs its function will typically slip after substantial use because of natural wear and tear on the parts of the clutch performing its proper function.

The prior art also teaches the ability of the torque limiting mechanisms to be adjusted to function at various levels of torque experienced by the mechanism. Although this helps in machines that have interchangeable motors, drums and snakes that can handle different levels of torque without damage to the device, it also allows for the torque level to be incorrectly adjusted and therein negate the desired effect of the mechanism. For example it is common for snakes to be interchangeable with drum augers and sewer cleaning machines. Different snakes can withstand different levels of torque without being damaged. In a situation where a snake is changed or substituted, the operator would have to adjust the clutch or torque limiting mechanism to correctly function at a torque level below that which is the maximum torque level which the snake can withstand. Where the torque limiting mechanism is not properly adjusted and set at an excessive torque level the snake may be damaged. This problem may be even more likely to occur in situations where a novice is operating the machine.

Additionally, snakes, because of their coiled spring construction, exhibit different properties depending on the direction of axial rotation and axial displacement. A snake may be rotated axially in a forward direction or a reverse direction. Rotating in the forward direction will cause the coils of the snake to compact when they encounter an obstruction. In such a situation the coiling allows the snake to withstand and exert a greater force upon an obstruction. Alternatively when a snake rotates axially, in reverse, the coiled snake will tend to unwind and definitely unwind if the snake becomes stuck in an obstruction. As a snake uncoils, reduced force on the snake should be applied or the snake will be damaged and/or possibly broken. Therefore, the likelihood of damage to the snake because of an increase in torque or another force upon the snake is greater when operated in a reverse direction than a forward direction.

The prior art shows a need for limiting torque and other rotational functionality on the various mechanisms of a drum auger by limiting the ability of the operator to control the direction of rotation of the motor, drum and snake.

SUMMARY OF THE INVENTION

One of the objects of the present invention is to provide a new and significantly improved portable drum auger or drain cleaning device where the rotational control is biased towards the off position and has the ability to be locked in a forward position.

It is another object of the present invention to reduce deterioration and damage to the motor, drum and snake used in the portable drum augers.

It is another object of the present invention to reduce deterioration and damage to mechanical components working in conjunction with the motor, drum and snake used in portable drum augers.

It is another object of the present invention to allow the operator to be free to perform other functions of the machine and/or other actions relating to its operation when the rotational control is the forward direction.

In accordance with one aspect of the invention, generally stated, a drum auger includes a frame. Such frame may have wheels attached to its base to facilitate easy transportation and movement of the device. The frame may also have plastic caps placed on its legs to provide greater friction with the ground.

A motor and drum are connected to the frame. The motor supplies a force to the drum to allow rotation of the drum in a forward or reverse rotation. The motor and drum may be connected by various mechanisms known in the prior art. A snake is housed within the drum and coiled therein about the drum axis extending outwardly from the drum. Various tools which perform different and or multiple functions in removing obstructions from pipes or sewers may be optionally attached to the end of the snake During operation of the invention, the snake is elongated from the drum and inserted into a pipe or conduit. This may be done manually by pulling the snake out of the drum and inserting into the desired pipe or conduit. It is also common for elongation of the snake to be controlled by a feed mechanism. Feed mechanisms generally use the coil structure of the snake and rotation of the drum to elongate or retract a snake into or out of a pipe. When such mechanisms engage the snake, the coils of the snake have a threaded screw like effect. Just as the direction of the rotation of a screw determines whether the screw goes in or out of an object so does the axial rotation of the snake determine whether a snake will extend into or retract from the drum and/or pipe.

A rotational control device may also be used in conjunction with the motor and the drum to determine whether the drum rotates, and in which direction it rotates. Rotation of the drum can be in a forward or reverse direction. The rotational control may have at least the three positions of forward, off, and reverse. When the rotational control is placed in the forward or reverse positions the drum and snake will rotate in a corresponding forward or reverse direction. When the rotational control is placed in the off position the drum and snake will not rotate. The rotational control is typically biased in the off position making it the default position. The rotational control must typically therefore be manually moved to either a forward or reverse position. When in the forward position, the rotational control can be locked, wherein the rotational control will not automatically return to the off position. Examples of a rotational control include, but are not limited to, a switch, lever, knob or dial among other possibilities.

The rotational control may additionally serve other functions in conjunction with controlling rotation of the drum and snake. For example, the rotational control may additionally act as a power switch to the motor.

A second switch may be used to control the power supply generally to the machine. A pneumatic switch may also be optionally used to further control the supply of power to the motor or supply of power to a rotational control. A feed mechanism may also optionally be used to aid in the introduction and retraction of the snake from a pipe, sewer, conduit or similar hollowed space.

DETAILED DESCRIPTION OF THE PREFERRED EMBODIMENTS

Figure 1:
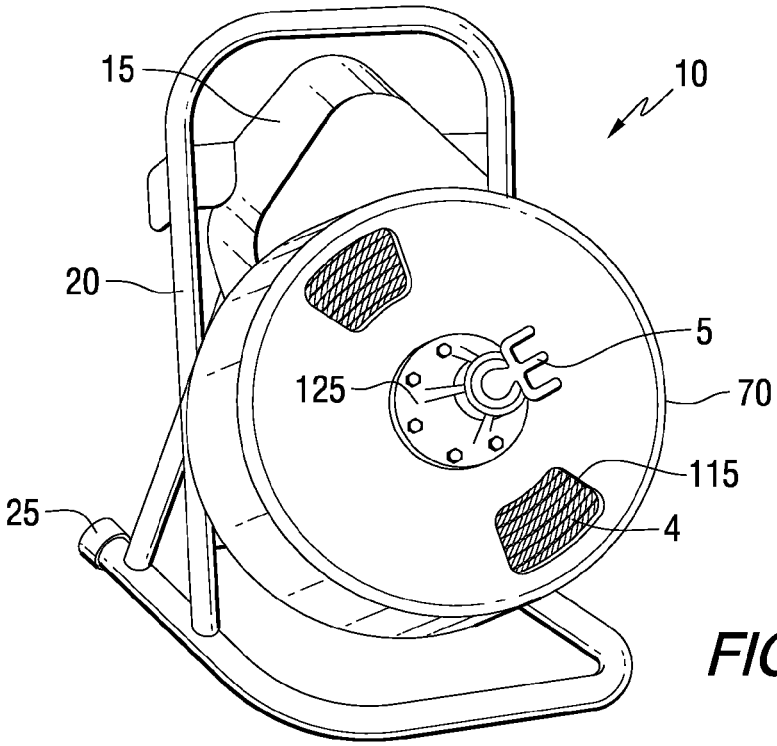
FIG. 1 is a perspective view of one embodiment of the invention.
Figure 2:
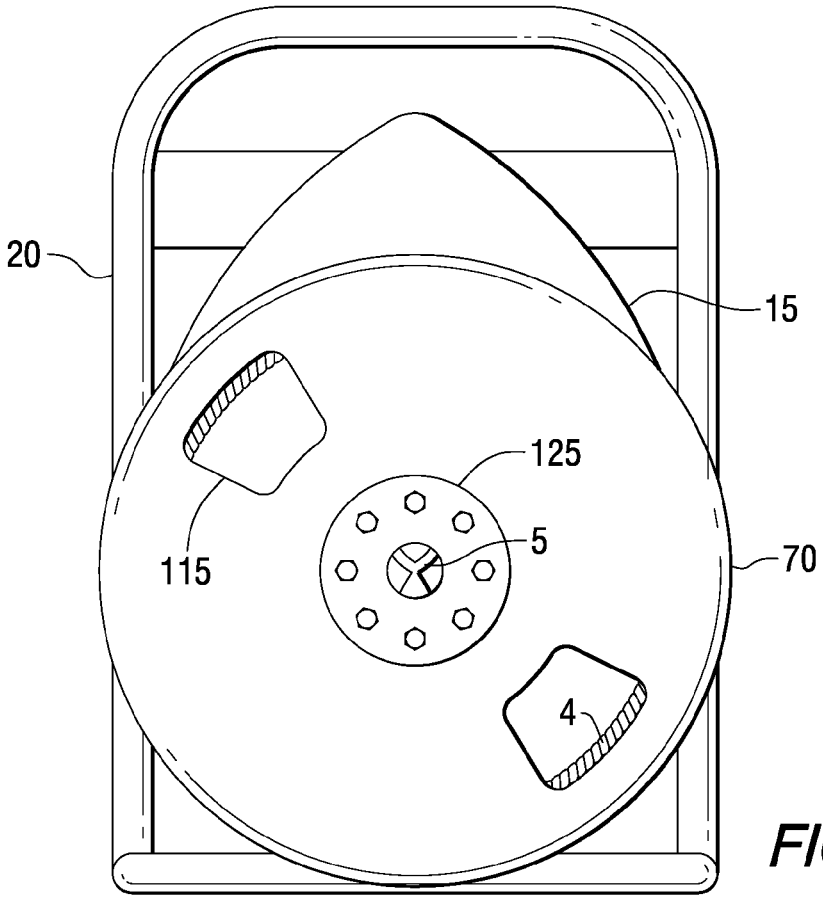
FIG. 2. is a front elevation of one embodiment of the invention
Figure 3:
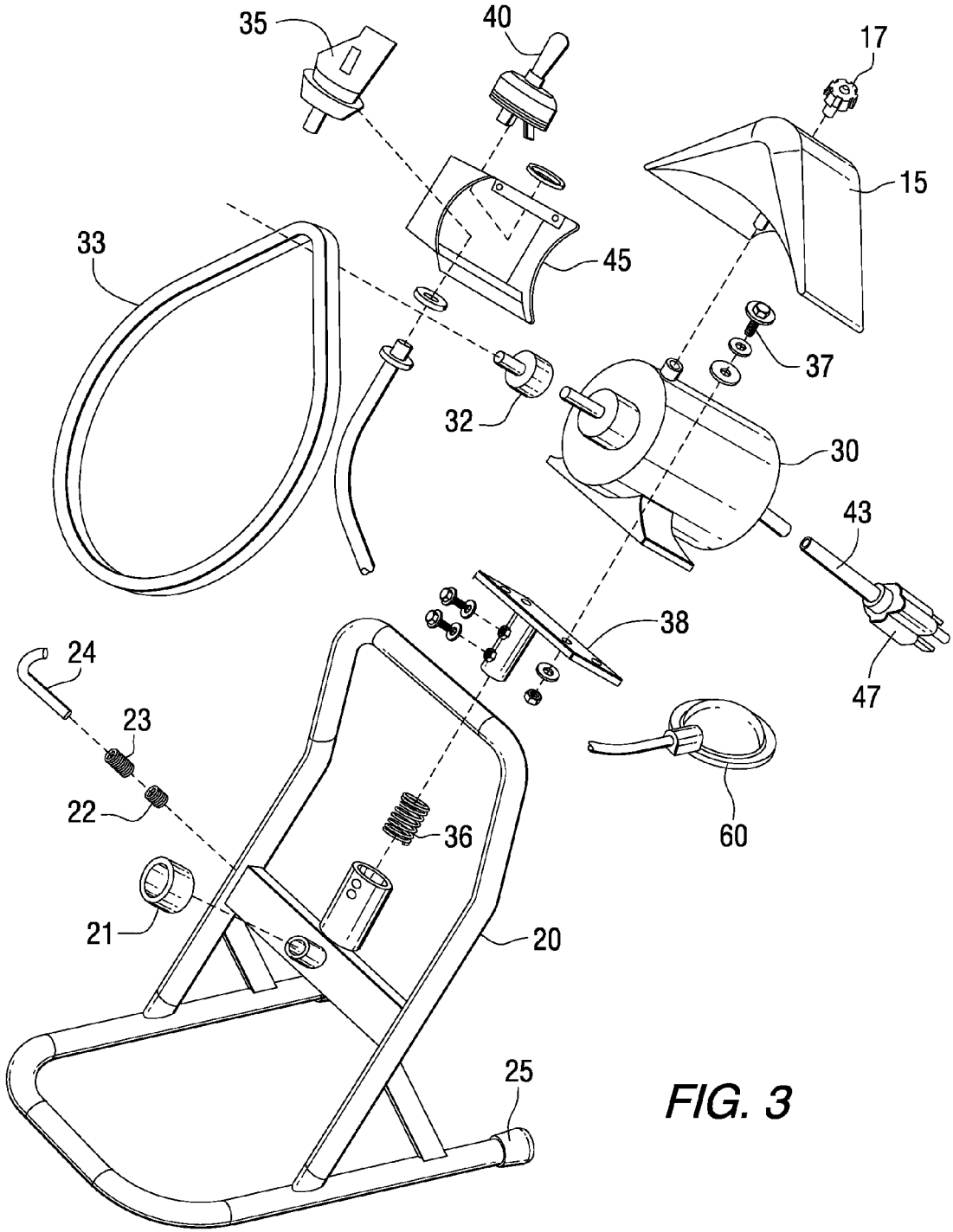
FIG. 3. is an exploded perspective view of the component parts of the invention including the frame, motor and rotational control of FIG. 1 and FIG. 2.
Figure 4:
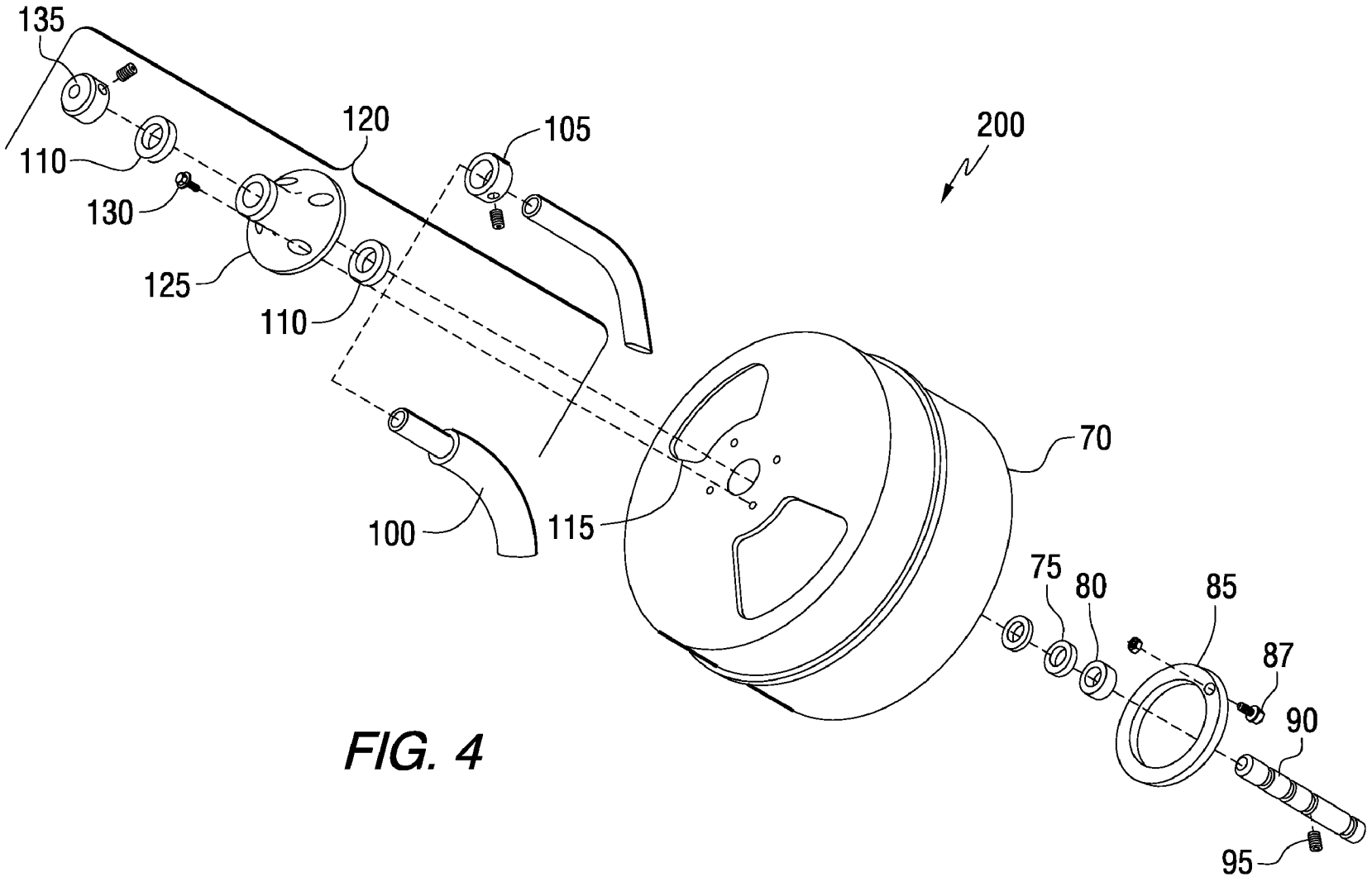
FIG. 4. is an exploded view of the component parts of the drum in FIG. 1 and FIG. 2.

Referring in greater detail to the drawings, which are illustrations of preferred embodiments of the invention only and are not for limiting the invention, FIGS. 1-4 and FIG. 9-11 present a typical belt driven drum auger machine 10 having a frame 20. The frame is lightweight and portable and may have wheels attached to it. Rubber leg tips 25 increase stability of frame 20 and the machine 10.

Motor 30 is attached to a motor support 38 with guide screws 37. The motor support 38 attaches to the frame 20. A motor support spring 36 acts as a shock absorber between the motor support 38 and the frame 20. A V belt pulley 32 attaches to the front of the motor 30. A V belt 33 attaches and wraps around the V belt pulley 32 and drum shell 70 therein translating the forces of the motor 30 to the drum shell 70. The drum shell rotates about its drum axis.

The distributor tube 100 is attached inside drum shell 70 and allows the snake 4 to be pulled to and distributed from the center of drum shell 70. The snake 4 is coiled inside drum shell 70 and affixed therein. The snake 4 protrudes from the center of front hub 125 and may be fitted with a snake tool 5. The drum assembly 200 attaches to motor 30 through shaft 90. Belt guard 15 covers the belt and motor and is secured by knob 17.

The rotational control 40 is attached to the cover box 45. The cover box 45 also encases the power switch diaphragm 35 which may be connected to a pneumatic pedal 60. The cover box 45 sits on one side of the motor 30.

Figure 5:
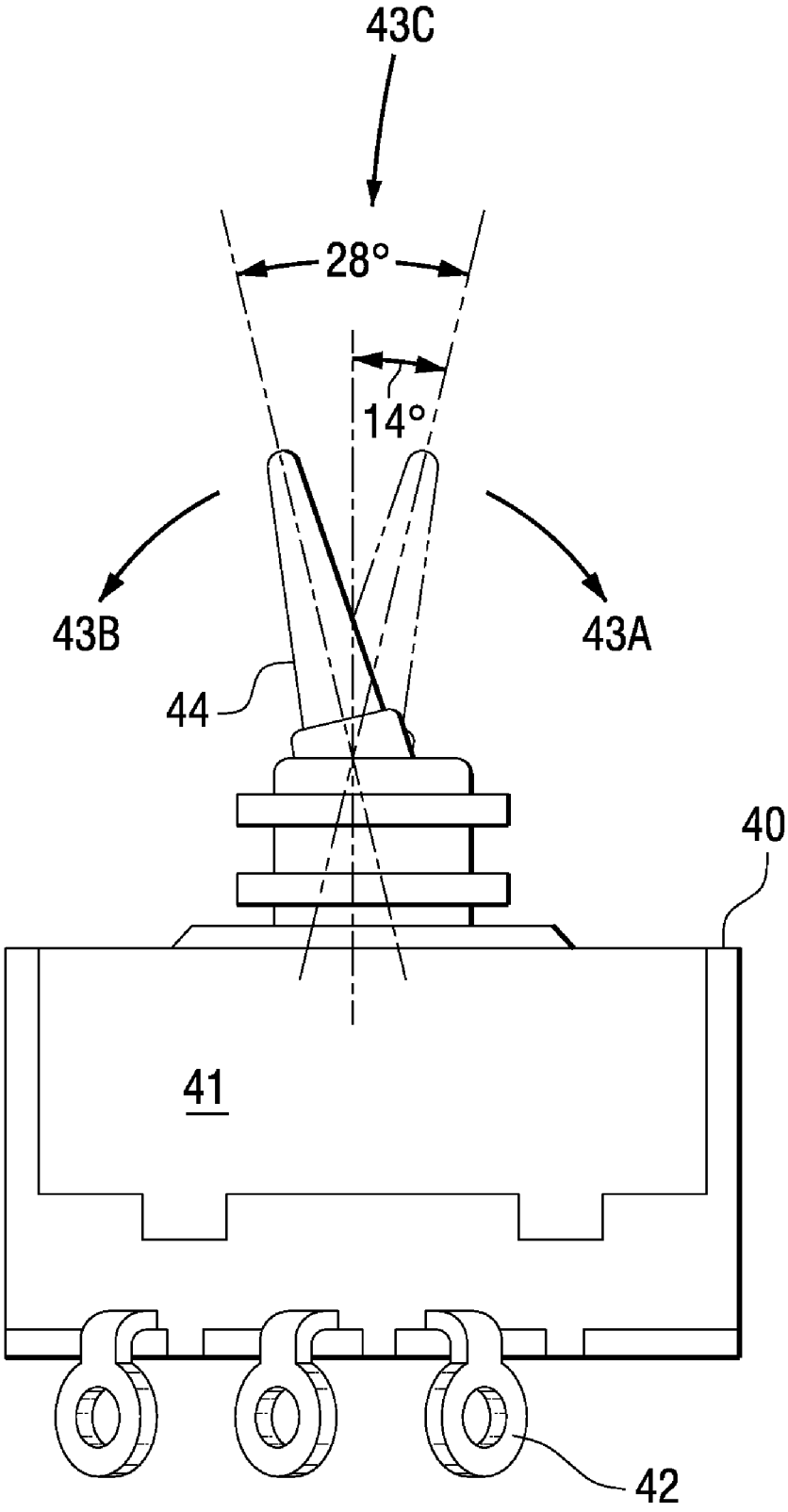
FIG. 5. is a sectional view of one embodiment of the rotational control device in FIG. 3.
Figure 6:
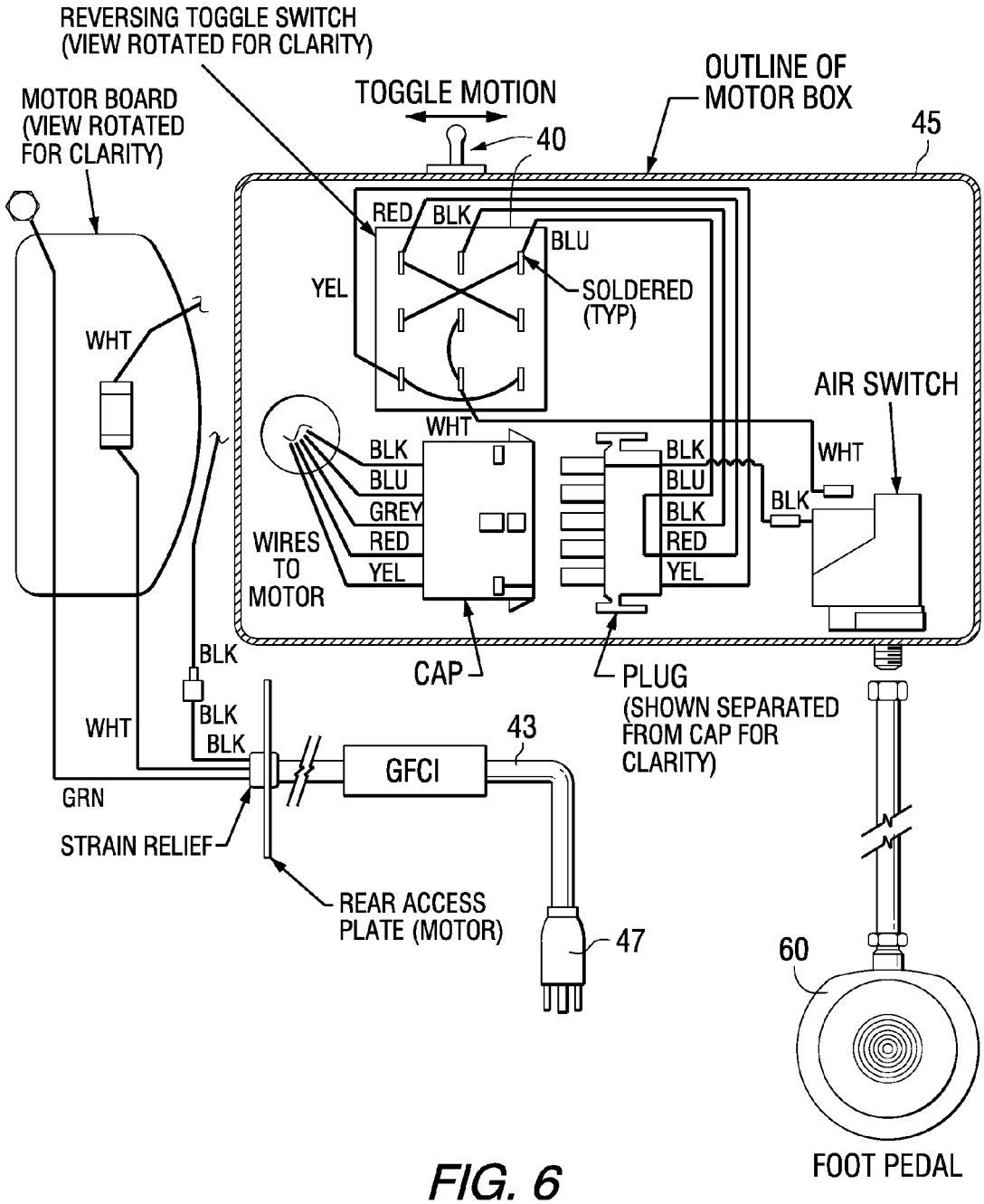
FIG. 6. is a electrical schematic of the rotational control device as in FIG. 3 and FIG. 5.
Figure 7:
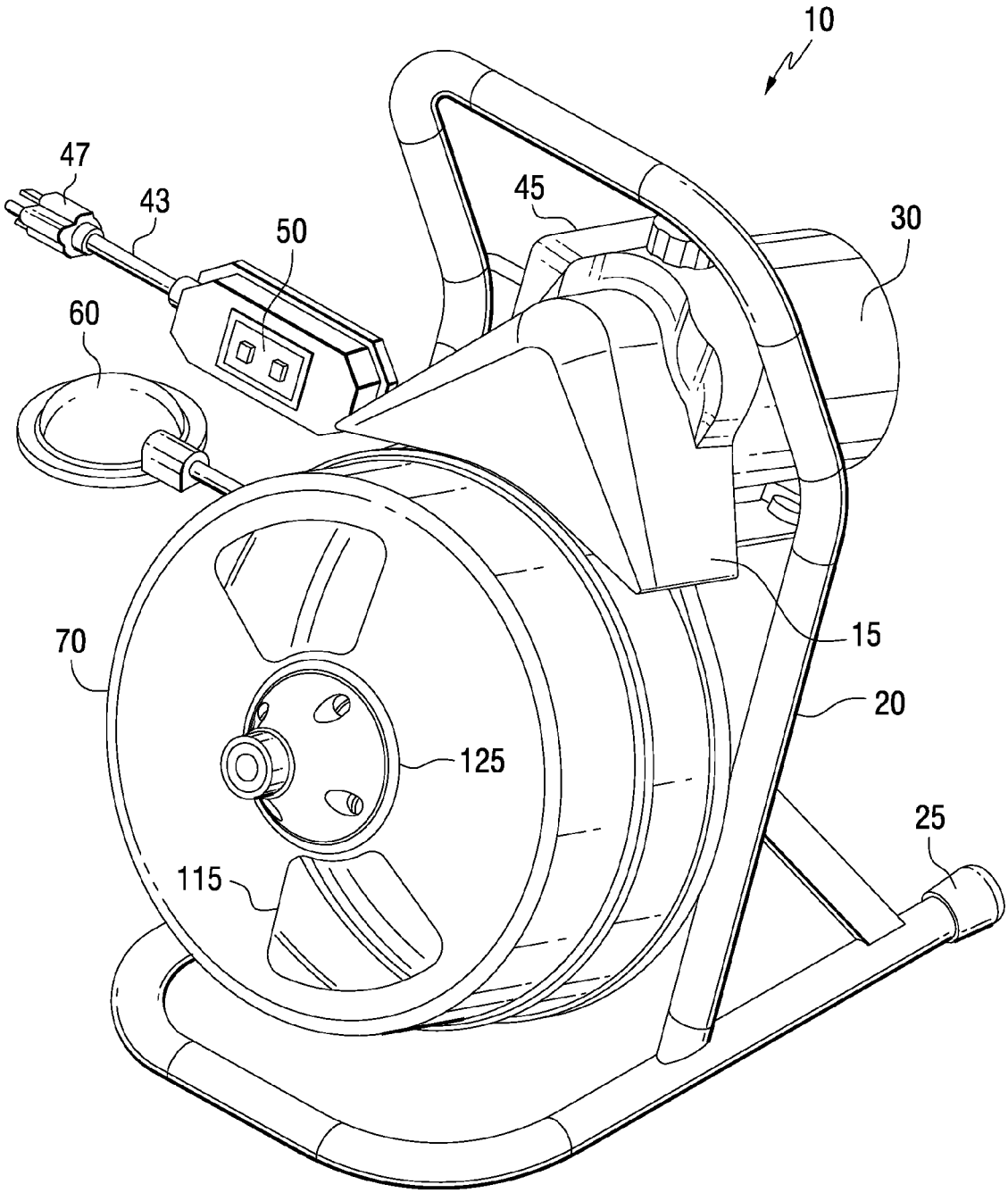
FIG. 7. is a front perspective view of one embodiment of the invention.
Figure 8:
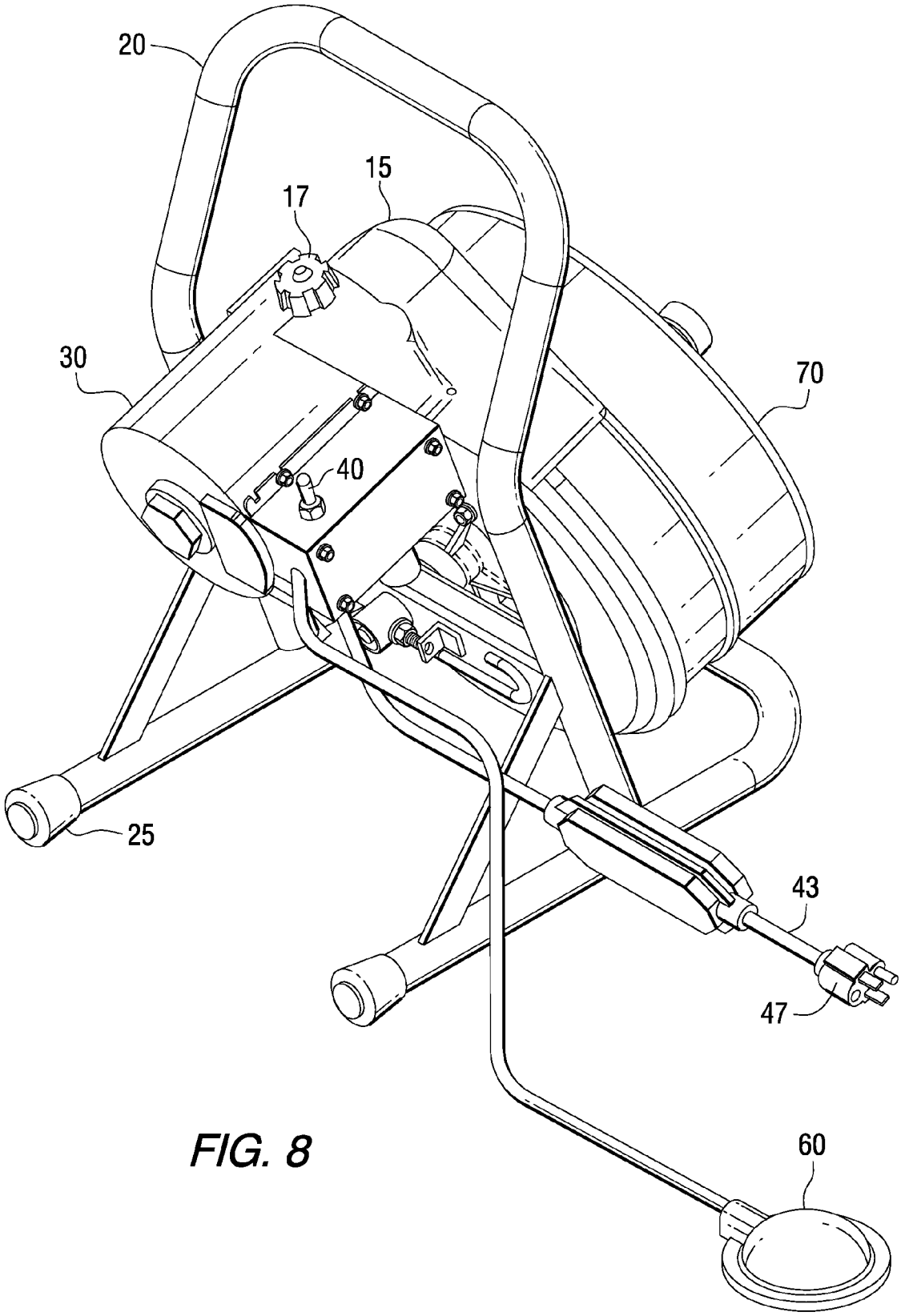
FIG. 8. is a rear perspective view of one embodiment of the invention.
Figure 9:
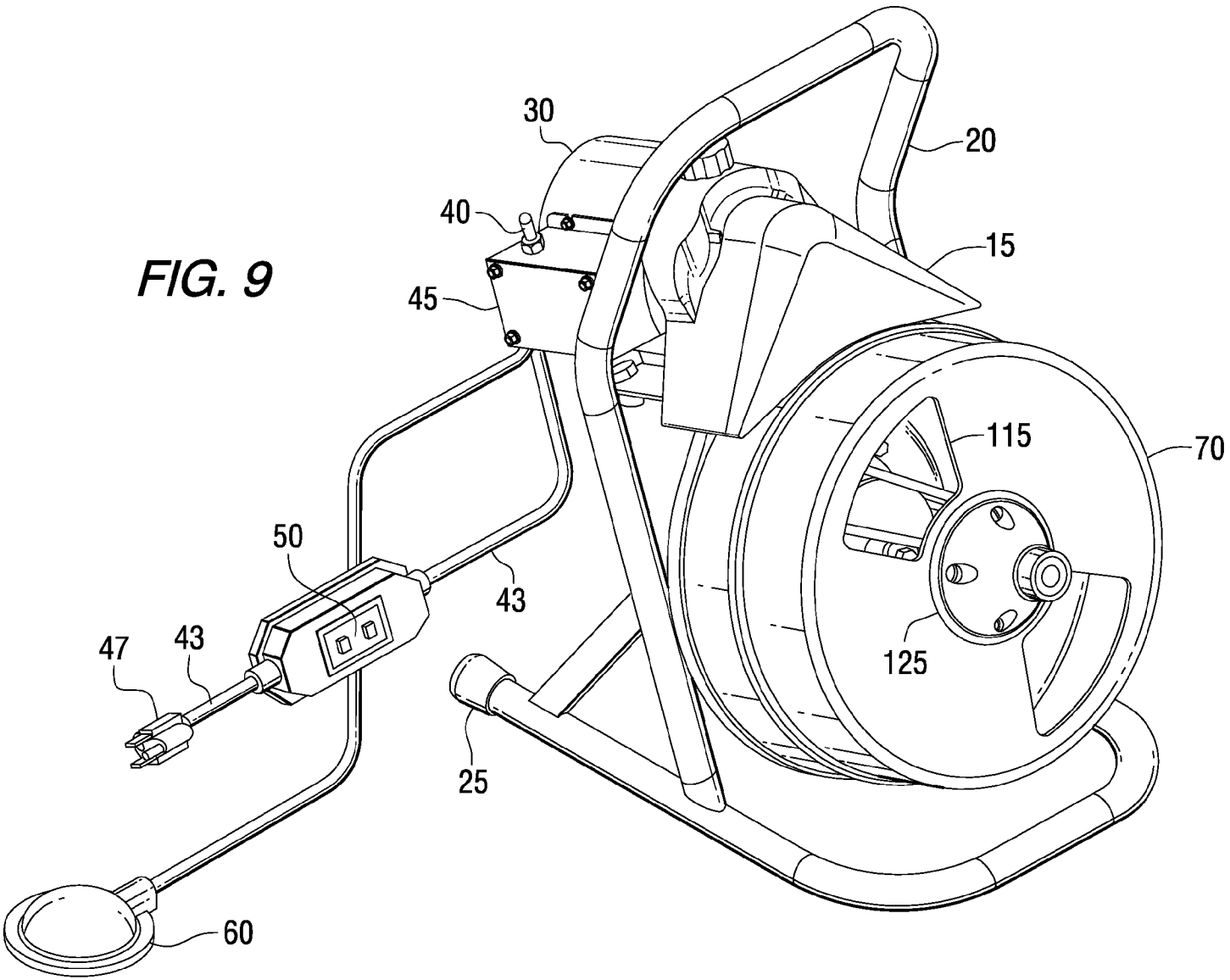
FIG. 9. is a front perspective view, from the opposite angle as shown in FIG. 7, of one embodiment of the invention.
Figure 10:
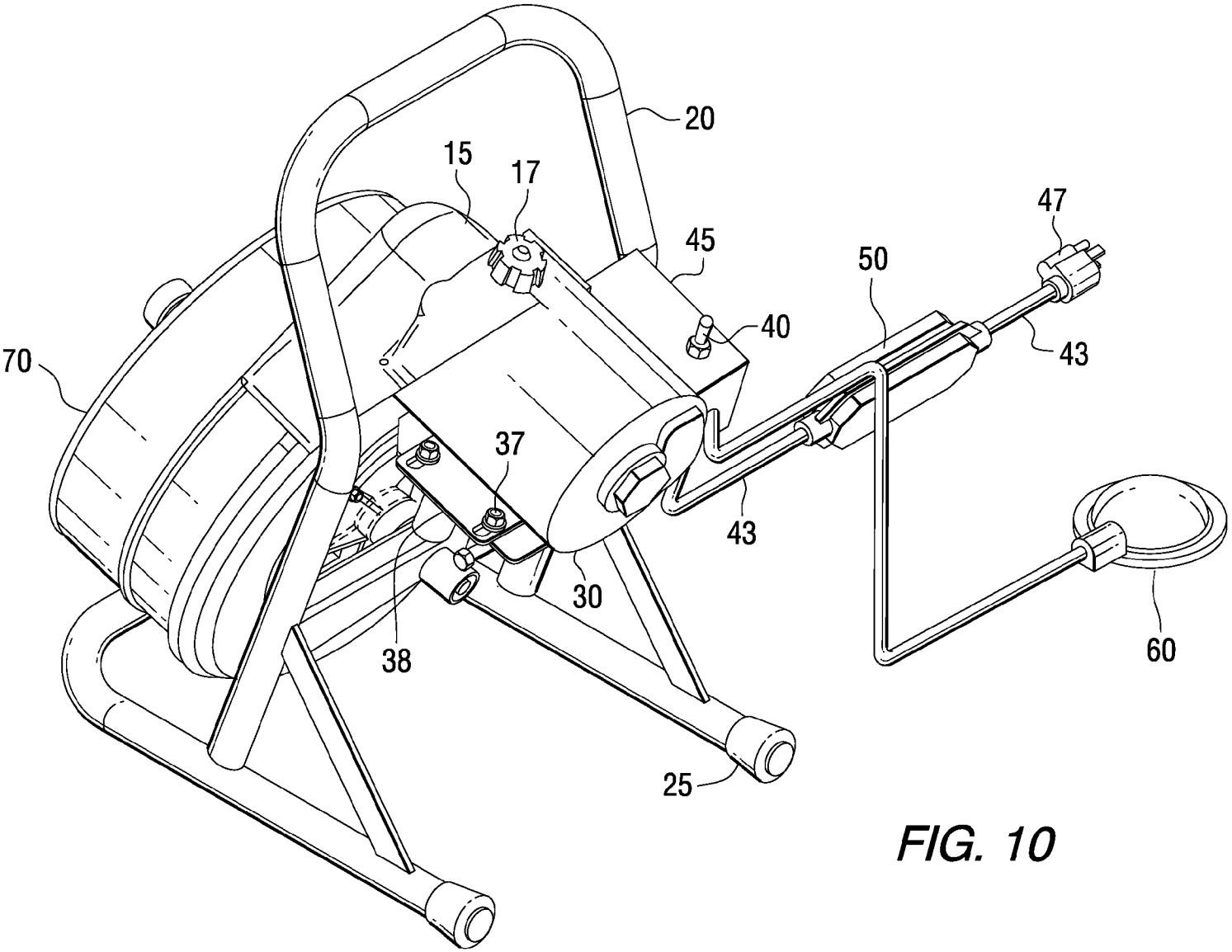
FIG. 10 is a rear perspective view, from the opposite angle as shown in FIG. 8, of one embodiment of the invention.

Motor 30 has cord 43 and plug 47 which allow the motor to connect to an electrical outlet to supply power to the machine. Ground fault interruption 50, as depicted in FIG. 8, may additionally be connected in concert with the cord 43 and motor 30 to control the flow of electrical current to motor 30 and detect miswiring faults in the electrical service. FIG. 5 shows rotational control 40 as a toggle switch. FIG. 6 depicts the wiring of rotational control 40 and pneumatic pedal 60 to motor 30.

Referring now to FIG. 5, rotational control 40 is comprised of a housing 41 and electrical contacts 42. Rotational control 40 is typically a double pole double throw switch having a toggle 44 which is spring biased away from both contact positions 43A, B to neutral or off position 43C. Arbitrarily labeling position 43A as forward and position 43B as reverse, toggle 44 of rotational control 40 is lockable in position 43A, forward, but solely spring biased from position 43B to position 43C. This permits normal hands free use of rotational control 40 during forward operation but requires the user to annually depress toggle 44 of rotational control 40 into the reverse position 43B continuously during such reverse operation. This maintains the user's attention on the reverse operation as well as prevents unattended use of the devices while in the reverse mode. This is specifically intended to reduce or eliminate the accidental or careless uncoiling or unwinding of the spring snake 4 during such activity. In many cases, typical reverse operation of the drum shell 70 is utilized by novice or careless users to retract snake 4 from the pipe or to attempt to disengage a snake tool 5 from an obstruction. The appropriate use of snake 4 is to manually retract the snake 4 by hand into drum shell 70.

In operation the user will place the drum auger machine 10 close to pipe or sewer. The operator will then elongate the snake 4 by pulling the end protruding from front hub 125 and feed the snake 4 into the pipe. Once the operator has hit an obstruction in a pipe or conduit with the snake the operator may then move toggle 44 of rotational control 40 to forward position 43A. Once the rotational control is in forward position 43A the operator may engage the motor 30 by activating pneumatic switch 60. When the machine is activated the drum shell 70 will rotate and translate its force to the snake 4 wherein the snake 4 or snake tool 5 will manipulate or engage the obstruction in the pipe. Activation of the machine can be further be other devices which may selectively control the flow of power to the motor 30.

The operator may lock toggle 44 of rotational control 40 while in the forward position 43A, therein freeing the operator from applying constant manual pressure to the rotational control 40 to keep it in the forward position. This will in turn allow the user to perform other tasks or functions while the rotational control is maintained in a forward position. The user activates the machine in reverse by placing toggle 44 of rotational control 40 in the reverse position 43A, however, constant manual pressure will be required on toggle 44 of rotational control 40 to permit the intermittent operation of the motor 30 and drum shell 70. Numerous variations in drum augers and other sewer cleaning machines of the present invention, within the scope of the claims, will occur to those skilled in the art in light of the foregoing disclosure.

What is claimed:

1. A drain cleaning apparatus comprising:

a frame;

a drum supported on said frame for rotation about a drum axis;

a drain cleaning snake coiled in said drum about said drum axis extending outwardly from said drum, said snake capable of being axially rotated;

a motor supported on said frame for rotating said drum and said snake, said motor capable of axially rotating said drum about said drum axis wherein such rotation of said drum is capable of causing both forward and reverse axial rotation of said snake; and a rotational controller, which determines the direction of rotation of said drum, permitting continuous operation of said motor in a forward axial mode and only intermittent operation of said motor in a reverse axial mode.

2. The drain cleaning apparatus as claimed in claim 1 wherein said rotational controller is selected from the group consisting of a switch, a lever and a dial.

3. The drain cleaning apparatus as claimed in claim 1 further comprising a pneumatic switch, said pneumatic switch selectively controlling the power to said motor.

4. A method for operating a drain cleaning device of the type having a rotational drum and coiled snake therein the method comprising selectively axially rotating said drum and said snake in two modes:

a continuous forward mode and an intermittent reverse mode; wherein the cleaning device further comprises a rotational controller and said method further comprises the step of manually activating the rotational controller to selectively permit continuous operation of said drain cleaning device in said forward axial mode and only intermittent operation of said motor in said reverse axial mode.

* * * * *